US005727256A

United States Patent [19]

Rudman

[11] Patent Number: 5,727,256

[45] Date of Patent: Mar. 17, 1998

[54] SUNLIGHT PROTECTING GARMENTS HAVING CONVECTIVE VENTILATION

[75] Inventor: Frank Rudman, N. Miami, Fla.

[73] Assignee: Sportailor, Inc., Miami, Fla.

[21] Appl. No.: 567,042

[22] Filed: Dec. 4, 1995

[51] Int. Cl.[6] ..... A41B 1/00

[52] U.S. Cl. ..... 2/115; 2/69; 2/DIG. 1

[58] Field of Search ..... 2/115, DIG. 1, 2/106, 69, 108, 105, 275, 85, 93, 94

[56] References Cited

U.S. PATENT DOCUMENTS

| | | | |
|---|---|---|---|
| 375,504 | 12/1887 | Norton | 2/DIG. 1 X |
| 1,360,390 | 11/1920 | Gifillan | 2/DIG. 1 X |
| 2,700,769 | 2/1955 | Polchinski | 2/DIG. 1 X |
| 2,715,226 | 8/1955 | Weiner | 2/DIG. 1 X |
| 3,086,215 | 4/1963 | Paola | 2/DIG. 1 X |
| 3,296,626 | 1/1967 | Ludwikowski | 2/DIG. 1 X |
| 4,722,099 | 2/1988 | Kratz | 2/DIG. 1 X |

*Primary Examiner*—Gloria Hale
*Attorney, Agent, or Firm*—Peter J. Georges

[57] ABSTRACT

A ventilated garment system is described that removes heat and moisture from a wearer's skin during hot weather while furnishing protection from direct sunlight. The system includes a pair of air outlet shoulder seams, a pair of air inlet side seams, and selectively at least one back seam, each shoulder seam including a zipper slide and a zipper tape, attached along welts to the fabric of the garment, and an underlying panel of stretchable mesh fabric, having a pleat therein, whereby movement of the zipper slides in the seams causes them to open and expose the panels of mesh fabric. Ambient air then enters the side and back seams into ventilation spaces between the garment and the skin of a wearer, moves convectively upwardly within the ventilation spaces toward the shoulder seams while receiving heat and moisture from the wearer's skin, and passes through the shoulder seams, thereby exiting the garment system and carrying away the heat and moisture. Each of the air inlet side seams and the air inlet back seams may also be provided with a zipper slide and a zipper tape and an underlying panel of stretchable mesh fabric. These convectively ventilated garments are useful both indoors and outdoors and during vigorous sports activities, wherein much body heat and moisture are generated by the wearer thereof.

19 Claims, 3 Drawing Sheets

FIG. 3
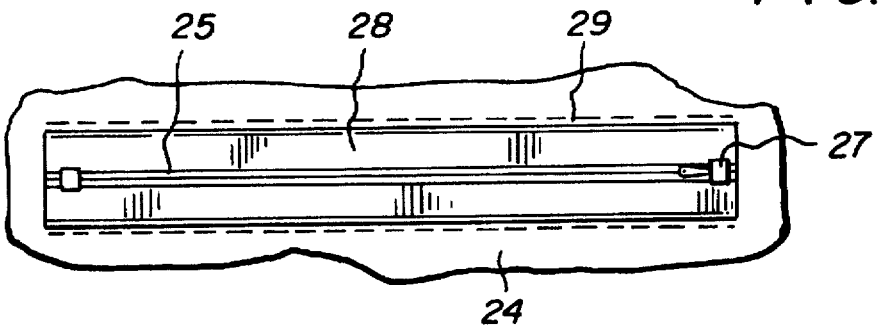
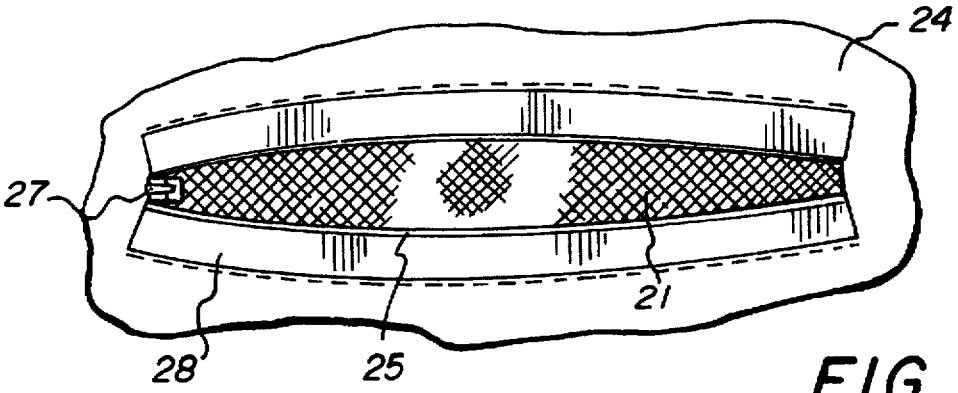
FIG. 4
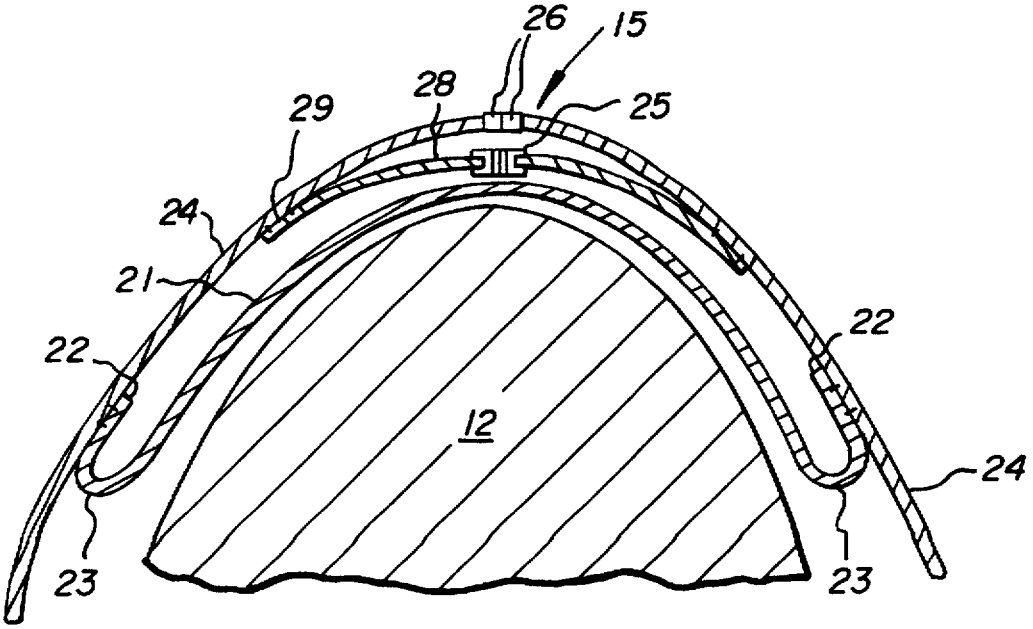
FIG. 6

SUNLIGHT PROTECTING GARMENTS HAVING CONVECTIVE VENTILATION

BACKGROUND OF THE INVENTION

1. Field of the Invention

This invention relates to upper body garments used in hot weather and particularly relates to such garments that protect the wearer from direct sunlight while providing convective ventilation that removes body heat and moisture.

1. Review of the Prior Art

People are becoming increasingly concerned about the damaging effects of direct sunlight upon human skin. It has been found that overexposing the skin to solar rays to the extent of causing sunburn increases the likelihood of developing skin cancer, especially deadly melanoma. In fact, subjecting the skin to even one blistering sunburn before the age of 20 can double a person's chances of developing melanoma later in life.

Not only does overexposure to sunlight increase the likelihood of skin cancer, it also causes premature aging of the skin. Years of even moderate exposure to the sun take their toll on the skin in the form of premature wrinkling and dry, leathery skin.

Recently, people have become more conscious of the deleterious effects of overexposure to solar rays and have begun to apply various protective preparations, especially sunblock lotions containing paraaminobenzoic acid (PABA), to their skins before exposure to the sun. As an alternative, many people customarily wear sun shades or wide brimmed hats or swathe their bodies in protective clothing.

Sunblock lotions, while reasonably effective, suffer from several disadvantages in that they are messy, time consuming to apply, expensive, and tend to wash off the skin due to perspiration or immersion in water.

Discomfort in hot weather is caused at least as much by high humidity as by high temperatures. If a man, for example, is wearing nothing but shorts, his skin is exposed to breezes and convective air movements that remove perspiration and the layer of warm, high-humidity air that naturally surrounds his skin so that he tends to feel relatively comfortable.

Nevertheless, due to increased concern over solar radiation, more people are wearing apparel that covers most of the body. However, in order for this apparel to protect the wearer's skin, it must be made of more tightly woven fabrics than are usually worn in hot weather. Such long-sleeved and long-legged clothing does effectively protect the skin if tightly woven, but this clothing cuts back on the breathing ability of the fabric and thereby the entry of breezes so that the clothing tends to be hot and uncomfortable in sunny weather. Furthermore, such clothing tends to constrict movement to some extent and is consequently unsuitable while playing golf and other active sports.

U.S. Pat. No. 2,713,168 describes an upper-body garment having air passage openings covered by side pleats in the garment material and extending lengthwise of the pleats with a slide fastener secured to the sides of each opening for selectively opening or closing the air passages. The ventilating openings beneath the pleats may be arranged to have oppositely opening slide fasteners to provide for a flow of limited amounts of air in cross ventilation fashion. No mesh material is included.

U.S. Pat. No. 4,513,451 relates to a garment, such as a suit for motorcycle riders having padded shoulders that do not open to permit escape of air, plus frontal vents on either side of zippers on the front torso of the suit and side vents running along either side of the suit up around the arm junctures. Each of these vents for permitting exit of air from the suit is essentially an aperture which is covered by one or more layers of a perforated fabric material such as a stretchable mesh. Zippers permit the flap to be selectively opened, the vent being covered with a perforated stretchable mesh material which permits the passage of air into the body of the jacket.

U.S. Pat. No. 4,722,099 discloses a motorcycle garment including mesh vents at locations requiring little protection, such as adjacent the underarms extending from chest to back, inside the elbow, and at the neck. The back is used as a conduit for cooling air which is provided by two closeable scoops positioned at the tops of the shoulders. The scoops are each constructed with inner and outer flaps. The inner flap extends inwardly underneath the outer flap. Preferably, flexible cloth mesh extends from the rearward portion of the inner flap to the forward leading edge of the outer flap in order to screen out bugs or other debris which might otherwise pass through the scoops. Air thus flows into, not out of, the shoulder scoops.

U.S. Pat. No. 5,105,478 describes a ventilated shirt including a shirt body and two sleeves attached thereto along shoulder seams thereof, the shirt body having a pair of elongated, side mesh inserts disposed between each pair of front and rear side seams immediately below seamed underarm portions.

Clearly there is a need for articles of clothing which shield the wearer's skin from harmful solar rays while being comfortable to wear when exposed to sunlight and even while engaged in active sports. There is particularly a need for a system of air circulation within a garment that will offer protection against heat and moisture buildup close to the wearer's skin.

SUMMARY OF THE INVENTION

It is an object of this invention to provide upper body garments that enable convective air movements to occur close to the wearer's skin for removing body heat and moisture and for introducing cooler and drier air inside the garments.

It is another object to provide such garments that are tightly enough woven to block harmful sunlight.

It is an additional object to provide a means for selective usage of air convection in such tightly woven garments.

It is a further object to provide garments that remove body heat buildup during active sports, whether outdoors or indoors.

In accordance with these objects and the principles of this invention, upper body garments are herein provided that include a ventilated shirt system, comprising selectively ventilated shoulder assemblies and selectively ventilated side seam assemblies, extending from armpit to waistline. This system enables convective air currents to rise beneath the garment to the shoulders and then to escape, carrying away body heat and moisture from perspiration, while fresh cool/cooler air enters the garment at the side seams.

Both the shoulder and side seam assemblies comprise zippered seams or their equivalents that are spanned with stretchable mesh material. Selective usage of the zippers enables selected amounts of cooler air to enter the side seams and form convective currents within the garment that exit from the shoulder seams. When the zippers are completely closed, the ventilated garment appears to be a conventional garment, such as a shirt.

The garment system of this invention operates on the principle of convective air circulation, created because hot air is lighter than cold air so that the hot air rises and is vented from the unobstructed discharge opening at the highest point of the garment, thereby causing a partial vacuum that is filled through lower openings in the sides and/or the back of the garment into which cooler air is pulled by the vacuum, thus creating an inside draft that carries away moisture and heat from the wearer's skin.

Specifically, movement of the zipper slides in the side seams and shoulder seams causes the side seams to open and form the inlet openings and the outlet openings, respectively, and allows ambient air to enter the side seams into ventilation spaces between the garment and the skin of a wearer, to move convectively upwardly within the ventilation spaces toward the shoulder seams while receiving heat and moisture from the wearer's skin, and to pass through the shoulder seams, thereby exiting the garment system and carrying away the absorbed heat and moisture.

The side inlet openings, which may be constructed with or without an underlying panel of mesh fabric, are disposed adjacent to the side seams because sewing along these seams is easier. Although vertically disposed side inlet openings are preferred, it is also useful to provide them horizontally if they are higher than the location of a wearer's belt.

The ridge created by attaching the mesh fabric to the garment fabric creates enough of a pocket to allow convective air circulation to pass to the outlet opening formed at the shoulder. The mesh fabric has very small openings or holes, and the garment is oversized, so that constant moving of the garment slides the openings or holes over the skin, not allowing sunlight to hit the same area and cause damage to the skin. The stretch in the mesh fabric is mainly between the zippers but also exists between the ends of the zippers. For example, a preferred mesh fabric has 35% stretch between the zippers (from front to back of the wearer) and 10% stretch from end to end of the zippers (from neck to end of the wearer's shoulder).

As a preferred alternative to a pair of vertically disposed entrance openings in the back of the garment, an inlet opening is provided in the back of the garment that is horizontally disposed. This inlet opening may appear to be merely a slit when closed with a pair of engaged zippers. Alternatively, the back inlet opening may cover the entire back of the wearer and be covered by a downwardly extending flap, so that the back of the garment looks like a cape, with no zippers along the edges of the inlet opening.

Inlet or entrance openings are necessarily low level openings and may be provided without either zippers or mesh fabric because protection from sunlight is not usually needed for them. Such low level openings may have zippers and mesh fabric covering the space between the zippers, however, if annoying insects, such as mosquitoes, are to be expected.

Even though there is a need for maximum protection from direct sunlight, many people use half sleeves or short sleeves because they are accustomed to sunlight and such half or short sleeves are cooler than long sleeves. The convective ventilation system of this invention is effective and useful for garments having long, half, or short sleeves.

Garments constructed according to the principles of this invention are especially useful for outdoors sports activities because of the very significant body heat buildup that develops during such activities. Moreover, indoors sports activities can generate enough body heat that the convective ventilation system of this invention can provide useful relief.

The garment, such as a shirt, may be provided with a conventional buttoned or zippered front opening or may be a pullover garment, with or without a collar at the neck opening.

BRIEF DESCRIPTION OF THE DRAWINGS

FIG. 3 is a schematic front view of a closed zippered seam, with the flaps and free edges thereof being removed.

FIG. 4 is a schematic front view of an open zippered seam, exposing the flexible mesh therewithin, with the flaps and free edges thereof that form the seam being removed.

FIG. 6 is an exaggerated, schematic, and sectional view of a shoulder air outlet seam, taken in the direction of the arrows 6—6 in FIG. 1, with this seam being over the shoulder of a typical wearer.

DESCRIPTION OF THE PREFERRED EMBODIMENTS

Figure 1:
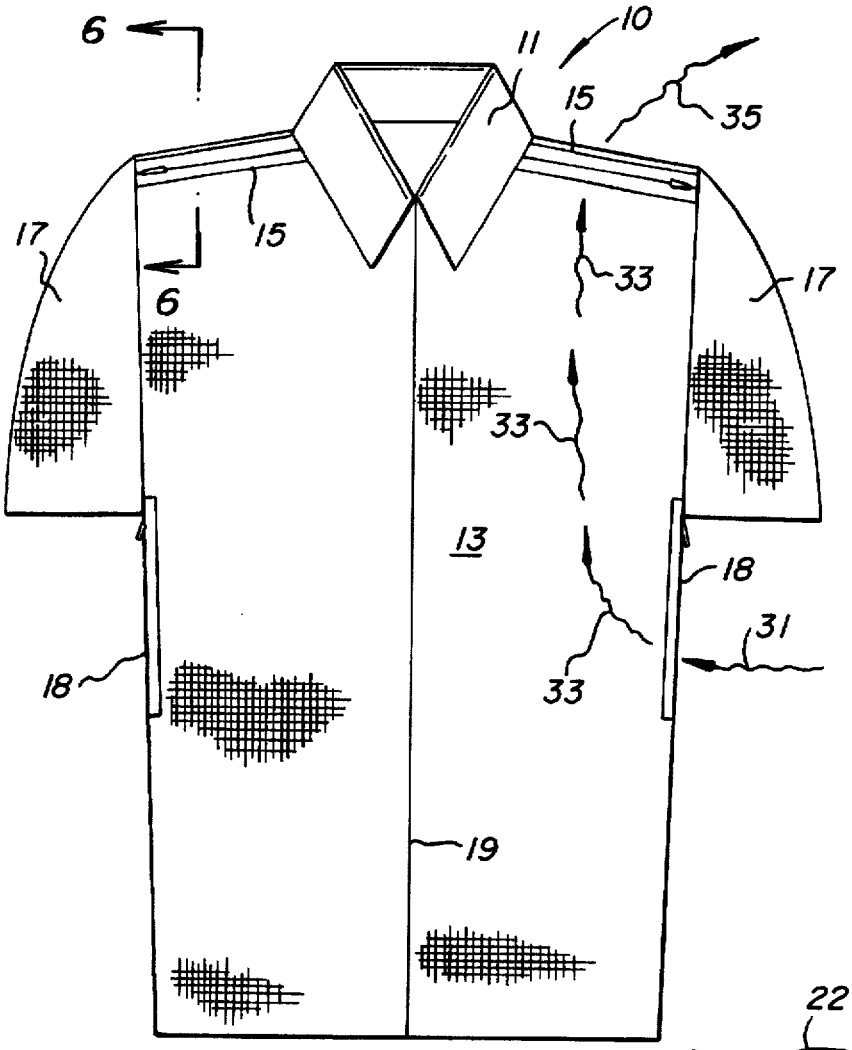
FIG. 1 is a front view of a ventilated shirt of this invention.
Figure 2:
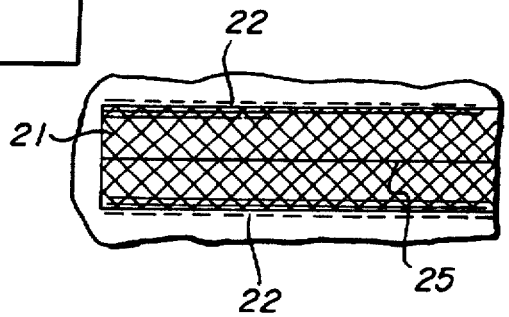
FIG. 2 is an inside view of a zippered ventilation seam that shows a pleat providing extra mesh fabric.
Figure 5:
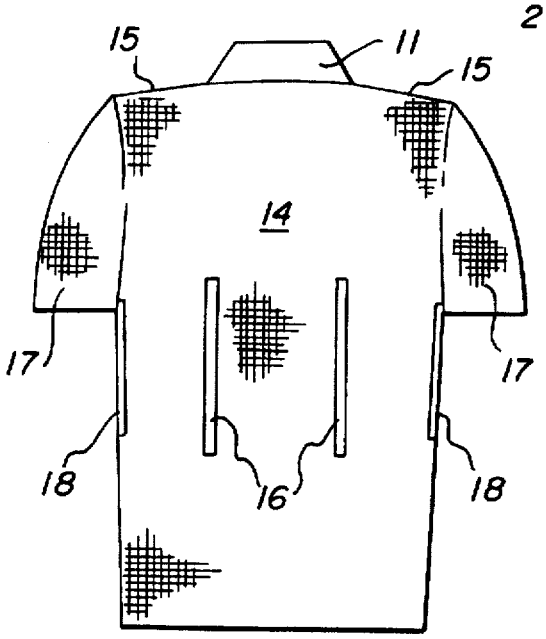
FIG. 5 is a back view of the ventilated shirt, showing a pair of inlet ventilation seams in the back thereof.

As shown in FIGS. 1–8, ventilated shirt system 10 is an example of a garment constructed according to this invention. System 10 comprises collar 11, shirt front 13, shirt back 14, shoulder seams 15, sleeves 17, side seams 18, front opening 19, vertical back seams 16, horizontal back seam 38, or open back covered with mesh fabric panel 41 and overlying cape 43.

Shoulder seams 15 are in the center of shoulder 12 of a typical human wearer, running sideways from the collar to the end of the shoulder. Side seams 18 run vertically from below the armpit to slightly above the waistline of the wearer. Back seams 16 are approximately the same length as side seams 18 and also run to slightly above the wearer's waistline, when vertically disposed as in FIG. 5; back seam 38 is parallel to and slightly above the waistline when disposed horizontally as in FIG. 7.

Stretchable mesh fabric 21 is a special mesh that is hydrophilic, soft, and flexible. It stretches mainly in one direction; for example, it stretches approximately 35% in one direction and approximately 10% at 90° thereto. Preferably, fabric 21 has about 35% stretch between the teeth of opened zipper 25, in the direction extending from front to back of the wearer, and about 10% stretch from end to end of zipper 25 in the direction extending from the wearer's neck to each end of the wearer's shoulders. It is attached, as also shown in FIG. 6, to shirt fabric 24 along welts 22 that are disposed outwardly of welts 29. It is disposed beneath zipper 25 as a pleat having bends 23 so that a wide expanse of mesh fabric 21 is exposed for air circulation, as shown in FIG. 4, when zipper slide 27 is moved to open zipper 25.

Right shoulder seam 15 is shown in FIG. 6 in closed position as an example of a ventilating seam of this invention. Flaps over zipper 25 have free edges 26 which form seam 15 when adjacent each other. Zipper 25 and zipper tape 28 are beneath edges 26, zipper tape 28 being attached to shirt fabric 24 along welts 29. Welts 29 are 5/16-inch welts. The widths of tape 28 and the distances between welts 29 and welts 22 are exaggerated in FIG. 6 for increased clarity.

Side seams 18 and back seams 29 are constructed in the same manner as shoulder seams 15. In order for air to circulate vertically, garments of this invention must be fitted loosely to the wearer. A loosely fitting outer garment, such as a cape, may also be worn above shirt 10 if similarly provided with shoulder, side, and back seams to permit entrance of cool, dry air and exit of warm, moist air. Collar 11 may be omitted so that shoulder seams 15 extend sideways from adjacent the neck opening to the end of the shoulders. Sleeves 17 may be long sleeves that may also be fitted with zippered seams along the inseams thereof.

Convective circulation of air is illustrated in FIG. 1 by entering air current 31 approaching opened side seam 18, upwardly rising air currents 33 inside of shirt 10, and exiting air current 35 above opened shoulder seam 15.

Figure 7:
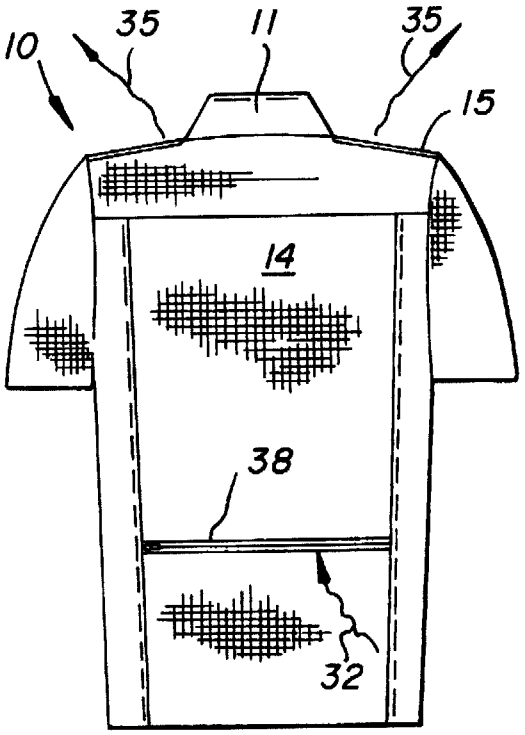
FIG. 7 is a back view of an alternative shirt of the invention in which a single air inlet back seam, horizontally disposed, is provided slightly above the belt line of the wearer.

In FIG. 7, an alternative embodiment of the back seam is shown. This air inlet back seam 38 is horizontally disposed and is slightly above the wearer's waistline. It is constructed in exactly the same way as air inlet side seams 18; in other words, it may have an underlying panel of mesh fabric, as shown in FIG. 6 for air outlet shoulder seams 15, or it may have no mesh fabric covering the opening formed by moving its zipper. Cooler air streams 32 are shown approaching back seam 32 to form more convective air currents 33 beneath the garment as they rise toward shoulder seams 15, leaving as exiting air currents 35.

Figure 8:
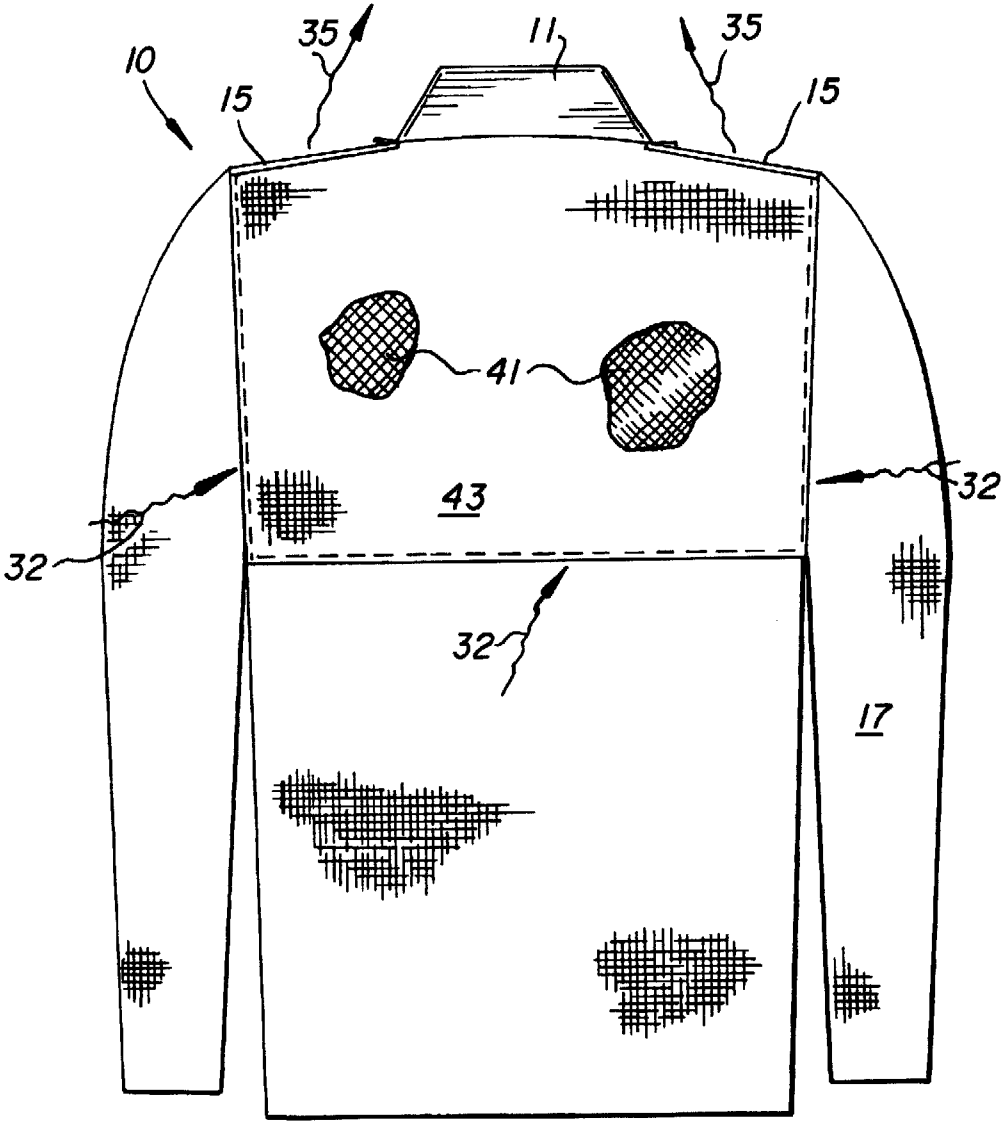
FIG. 8 is a back view of an alternative garment of the invention in which the air inlet opening, covered with a panel of mesh fabric, extends from one side seam to the other side seam and from the shoulders and neck of the wearer to slightly above the belt line of the wearer, this extensive air inlet opening being covered with a loosely hanging panel of fabric so that the garment resembles a cape.

In FIG. 8, another alternative embodiment of the back seam is shown, but it is not a seam at all. It is instead a wide back opening extending over the entire upper part of the wearer's back. This opening may or may not be covered by a coextensive and pleated panel of stretchable mesh fabric 41 that is attached at the edges thereof to shirt fabric 24 along all edges of the back opening. Overlying this wide opening and selectively this panel of mesh fabric is a panel 43 of shirt fabric that drapes below the bottom edge of this back opening and looks like a cape. Panel 43 is attached to shirt fabric 24 along its top edge, near shoulder seams 15 and collar 11. Streams 32 of inlet air are shown approaching the bottom and lower sides of this back opening to pass beneath cape 43 and form convective air currents 33 (see FIG. 1), and depart from shoulder seams 15 as exiting air currents 35.

It is apparent that innumerable variations of the preferred embodiments described hereinbefore may be utilized. However, all such variations within the spirit and scope of the invention are deemed to be covered by the following claims.

What is claimed is:

1. A ventilated garment system in a garment made of garment fabric and having a front, a back, a neck opening, sides, shoulders having ends, sleeves extending from said shoulders and forming armpits with said sides of said garment, a pair of openable side seams in said sides that extend downwardly from beneath said armpits to the waistline of a wearer, being selectively opened and closed with a zipper assembly attached to said fabric of said garment along welts, and a pair of shoulder seams at said shoulders that extend from said neck opening to said ends of said shoulders, said garment being made of said fabric that is woven sufficiently tightly to offer protection from sunlight, wherein each of said shoulder seams comprises:

(a) a zipper assembly that comprises a zipper tape and a zipper slide, said tape being attached along welts to said garment fabric to form each said seam; and (b) a panel of stretchable mesh fabric, having sides and a pleat therein, that is disposed beneath said zipper assembly and is attached along said sides of said panel to said garment fabric, outside of said welts;

whereby movement of said zipper slides in said side seams and said shoulder seams causes said shoulder seams to open, exposing said panels of mesh fabric covering said shoulders of said wearer, and allows ambient air to enter said side seams into ventilation spaces between said garment and the skin of a wearer, to move convectively upwardly within said ventilation spaces toward said shoulder seams while receiving heat and moisture from said wearer's skin, and to pass through said shoulder seams, thereby exiting said garment system and carrying away said heat and said moisture.

2. The ventilated garment system of claim 1, wherein each of said side seams additionally comprises a panel of stretchable mesh fabric, having sides and a pleat therein, that is disposed beneath said zipper assembly and is attached along said sides of said panel said garment fabric, outwardly of said welts.

3. The ventilated garment system of claim 1, wherein said zipper slides are moved a selected distance, thereby opening said shoulder seams to a selected extent and allowing a selected amount of said ambient air to exit from said shoulder seams.

4. The ventilated garment system of claim 1, wherein a collar is attached to said neck opening.

5. The ventilated garment system of claim 1, wherein said mesh fabric is stretchable mainly in one direction.

6. The ventilated garment system of claim 5, wherein said stretchable mesh fabric has approximately 35% stretch between said zippers in the direction extending from front to back of said wearer and approximately 10% stretch from end to end of said zippers in the direction extending from said neck to the ends of said wearer's shoulders.

7. The ventilated garment system of claim 1, wherein at least one open back seam is additionally disposed vertically in said back of said garment.

8. The ventilated garment system of claim 7, wherein a pair of said back seams is disposed vertically in said back, each said back seam being disposed approximately midway between one said side of said garment and the middle of said back.

9. The ventilated garment system of claim 8, wherein each said back seam additionally comprises:

(a) a zipper assembly that comprises a zipper tape and a zipper slide, said tape being attached along welts to said garment fabric to form said back seam; and (b) a panel of stretchable mesh fabric, having sides and a pleat therein, that is disposed beneath said zipper assembly and is attached along said sides of said panel to said fabric, outwardly of said welts.

10. The ventilated garment system of claim 1, wherein a horizontally disposed air inlet opening is additionally provided in the back of said garment, said inlet opening having a zipper assembly and appearing to be a seam when closed.

11. The ventilated garment system of claim 10, wherein said back inlet opening further comprises a panel of stretchable mesh fabric, having a pleat therein, that is disposed beneath said zipper assembly and is attached along the sides thereof to said garment fabric, outwardly of said welts.

12. A ventilated garment system in a garment having a front, a back, sides a neck opening, shoulders, and sleeves extending from said shoulders and forming armpits with said sides of said garment, said garment being made of a garment fabric that is woven sufficiently tightly to offer protection from sunlight, wherein said garment system comprises:

(a) a side inlet air seam in each said side that extends downwardly from beneath said armpit approximately to the waistline of a wearer, said side seam comprising:

(1) a zipper assembly that comprises a zipper tape and a zipper slide, said tape being attached along welts to said garment fabric to form said side seam, and (2) a panel of stretchable mesh fabric, having sides and a pleat therein, that is disposed beneath said zipper assembly and is attached along said sides of said panel to said garment fabric, outwardly of said welts; and (b) an air outlet shoulder seam at each said shoulder that extends from adjacent said neck opening to the end of said shoulder, said shoulder seam comprising:

(1) a zipper assembly that comprises a zipper tape and a zipper slide, said tape being attached along welts to said garment fabric to form said shoulder seam, and (2) a panel of stretchable mesh fabric, having sides and a pleat therein, that is disposed beneath said zipper assembly and is attached along said sides of said panel to said garment fabric, outwardly of said welts;

whereby movement of said zipper slides in said side seams and said shoulder seams causes said side seams and said shoulder seams to open, exposing said panels of mesh fabric, and allows ambient air to enter said side seams and into ventilation spaces between said garment and the skin of a wearer, to move convectively upwardly within said ventilation spaces toward said shoulder seams while receiving heat and moisture from said wearer's skin, and to pass through said shoulder seams, thereby exiting said garment system and carrying away said heat and said moisture.

13. The ventilated garment system of claim 12, wherein said zipper slides are moved a selected distance, thereby opening said side seams and said shoulder seams to a selected extent and allowing a selected amount of said ambient air to enter said ventilation spaces.

14. The ventilated garment system of claim 12, wherein a collar is attached to said neck opening.

15. The ventilated garment system of claim 12, wherein said mesh fabric is stretchable mainly in one direction.

16. The ventilated garment system of claim 15, wherein said stretchable mesh fabric has 35% stretch between said zippers in the direction extending from front to back of said wearer and 10% stretch from end to end of said zippers in the direction extending from said neck to the ends of said wearer's shoulders.

17. The ventilated garment system of claim 12, wherein at least one back seam is additionally disposed vertically in said back.

18. The ventilated garment system of claim 17, wherein a pair of said back seams is disposed vertically in said back, each said seam being disposed approximately midway between one of said sides and the middle of said back.

19. The ventilated garment system of claim 18, wherein each said back seam comprises:

(a) a zipper assembly that comprises a zipper tape and a zipper slide, said tape being attached along welts to said garment fabric to form said back seam; and (b) a panel of stretchable mesh fabric, having a pleat therein, that is disposed beneath said zipper assembly and is attached along said sides of said panel garment to said garment fabric, outwardly of said welts.

* * * * *